US007023306B2

(12) United States Patent
Nishida et al.

(10) Patent No.: US 7,023,306 B2
(45) Date of Patent: Apr. 4, 2006

(54) ELECTROMAGNETIC RELAY

(75) Inventors: Takeshi Nishida, Muko (JP); Yasuyuki Masui, Otsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/014,221

(22) Filed: Dec. 16, 2004

(65) Prior Publication Data

US 2005/0151606 A1 Jul. 14, 2005

(30) Foreign Application Priority Data

Dec. 22, 2003 (JP) ..... P2003-425012

(51) Int. Cl.
*H01H 67/02* (2006.01)

(52) U.S. Cl. ..... 335/132; 335/128

(58) Field of Classification Search ..... 335/132, 335/202, 165–176, 250–256, 281–2, 78–86, 335/124, 128–131; 251/129.1–129.19; 123/90.1
See application file for complete search history.

(56) References Cited

U.S. PATENT DOCUMENTS 3,238,329 A * 3/1966 Russo ..... 335/131
5,519,370 A 5/1996 Perreira et al.
5,680,083 A * 10/1997 Kogawa et al. ..... 335/132
2004/0066261 A1 4/2004 Nishida et al.

FOREIGN PATENT DOCUMENTS

JP 9-510040 10/1997
WO WO 95/24051 9/1995

OTHER PUBLICATIONS

Patent Abstracts of Japan; Publication No. 2002-233201 dated Aug. 20, 2002 (1 page) (corresponds to AB above—U.S. Appl. No. 2004/0066261A1).

* cited by examiner

*Primary Examiner*—Lincoln Donovan
(74) *Attorney, Agent, or Firm*—Osha Liang LLP

(57) ABSTRACT

An electromagnetic relay includes an electromagnet block having coils wound about the bodies of spools through which iron cores are provided. The electromagnet block is accommodated in a concave part that opens upward of a box-shaped case such that the shaft centers of the iron cores can be orthogonal to the bottom surface of the box-shaped case. The electromagnet block is excited and demagnetized by the passage and break of electric current through the coils so that a contact mechanism can be driven by a movable iron piece that is absorbed to and leaves magnetic pole portions at the upper ends of the iron cores. In this case, the electromagnet block is hung at the upper opening edge of the box-shaped case such that a space can be provided between the bottom surface of the box-shaped case and the electromagnet block.

6 Claims, 18 Drawing Sheets

ELECTROMAGNETIC RELAY

BACKGROUND OF THE INVENTION

1. Field of the Invention

The present invention relates to an electromagnetic relay, and, more specifically, it relates to an electromagnetic relay having a sealed contact mechanism.

2. Description of the Related Art

Hitherto, a sealed relay apparatus disclosed in JP-T-9-510040 is one of switching apparatus for breaking direct current.

In other words, a plunger 9 touches and leaves a core center 4 based on excitation and demagnetization of coils 26 in a hollow cavity 40 so that an armature assembly 8 and armature shaft 10 integrated with the plunger 9 can slide toward the shaft center. Thus, a movable contact disk 21 touches and leaves fixed contacts 22 and 22.

However, the sealed relay apparatus has a problem that impact noise is caused when the plunger 9 touches the core center 4 and cannot be absorbed and mitigated, which is noisy.

SUMMARY OF THE INVENTION

The invention was made in view of the problem, and it is an object of the present invention to provide a silent electromagnetic relay, which can absorb and mitigate impact noise in switching contacts.

In order to achieve the object, an electromagnetic relay according to the invention includes an electromagnet block having coils wound about the bodies of spools through which iron cores are provided. The electromagnet block is accommodated in a concave part that opens upward of a box-shaped case such that the shaft centers of the iron cores can be orthogonal to the bottom surface of the box-shaped case. The electromagnet block is excited and demagnetized by the passage and break of electric current through the coils so that a contact mechanism can be driven by a movable iron piece that is absorbed to and leaves by magnetic pole portions at the upper ends of the iron cores. In this case, the electromagnet block is hung at the upper opening edge of the box-shaped case such that a space can be provided between the bottom surface of the box-shaped case and the electromagnet block.

According to the invention, an electromagnet block is hung at the upper opening edge of the box-shaped case, and the electromagnet block and the bottom surface of the box-shaped case do not directly touch each other. Thus, when the movable iron piece is abutted to the magnetic pole portions of the iron cores in driving the contact mechanism, vibration noise, which travels through a solid, does not travel from the iron cores to the bottom surface of the case directly. Therefore, a silent electromagnetic relay can be provided.

As an aspect of the invention, the electromagnet block may be hung at the upper opening edge of the box-shaped case through coil terminals at collars of the spools.

According to this aspect, when the movable iron piece is abutted to the magnetic pole portions of the iron cores, the coil terminals at the collars of the spools are elastically deformed so that the occurrence of traveling impact noise can be suppressed and a more silent electromagnetic relay having the advantage and the above-described advantages can be provided.

As another aspect of the invention, a sound-absorbing elastic material that absorbs and mitigates impact noise may be filled in the space between the bottom surface of the box-shaped case and the electromagnet block.

According to the aspect, a sound-absorbing elastic material can absorb vibration noise, which is caused when the movable iron piece is abutted to the magnetic pole portions of the iron cores and travels through a solid, and a much more silent electromagnetic relay can be provided.

As another aspect of the invention, the electromagnet block may have a pair of aligned iron cores connected by a yoke spanned across the lower ends of the iron cores.

According to the aspect, the traveling of vibration noise, which travels through a solid, can be suppressed since the yoke spanned across the lower ends of the iron cores is not directly abutted to the bottom surface of the box-shaped case. Thus, a silent electromagnetic relay can be provided.

DESCRIPTION OF THE PREFERRED EMBODIMENT

An embodiment according to the invention will be described with reference to FIGS. 1 to 18B.

Figure 1:
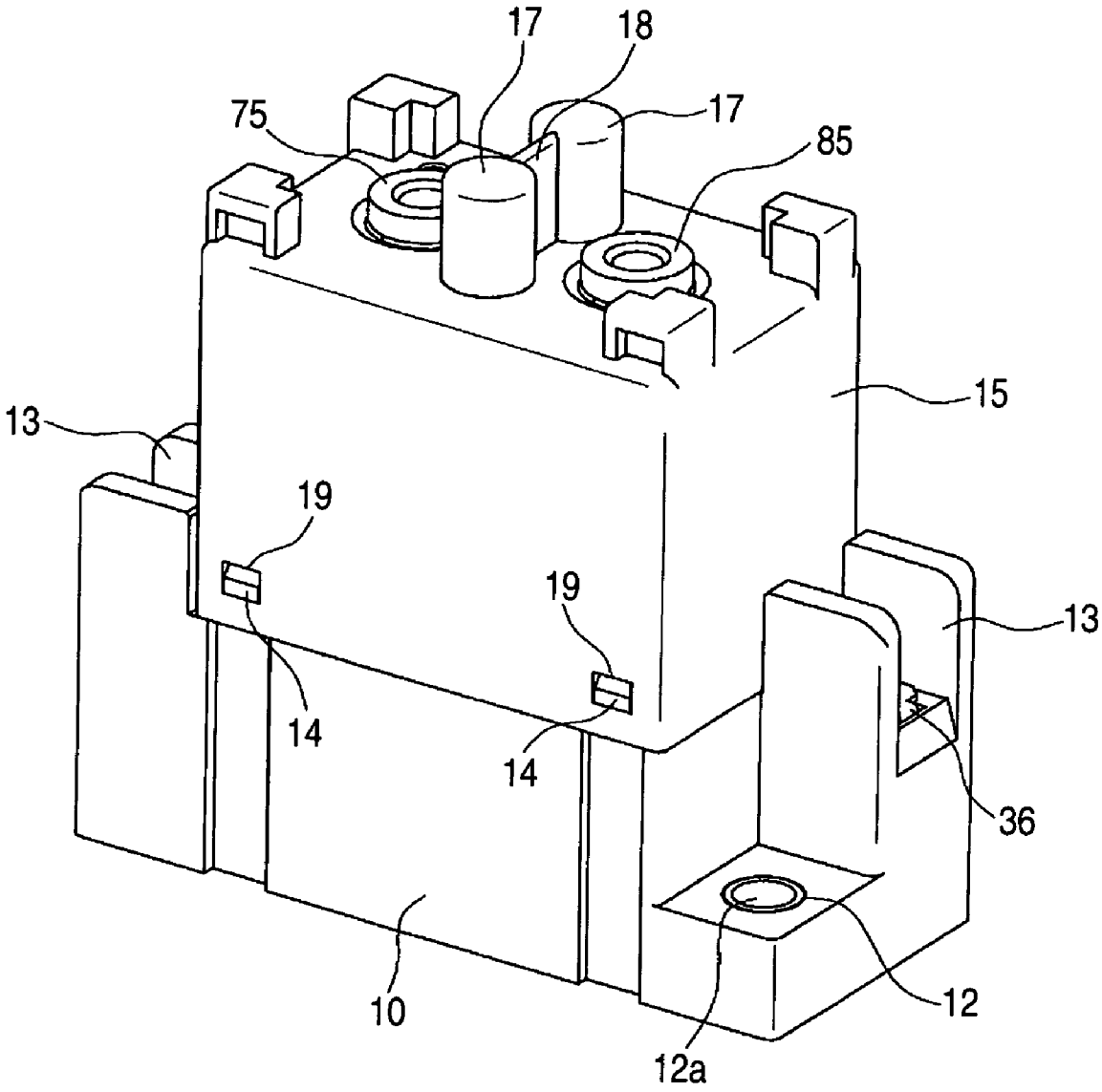
FIG. 1 is a perspective view illustrating an embodiment in which a switch apparatus according to the invention is applied to a direct current shutting relay.
Figure 2:
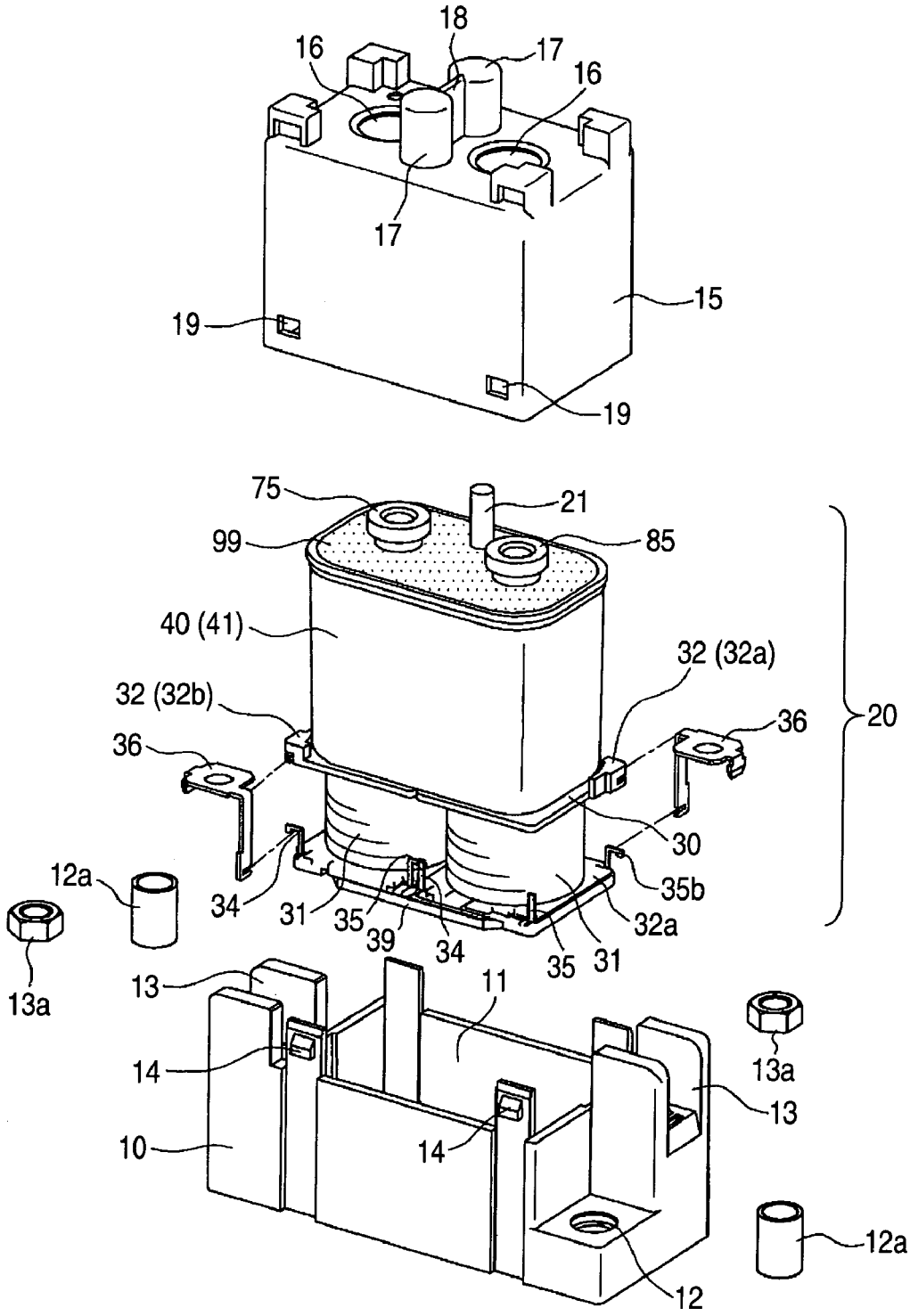
FIG. 2 is an exploded perspective view of FIG. 1.

This embodiment is a case that the invention is applied to a direct current load switching relay, and, as shown in FIGS. 1 and 2, a relay body 20 is accommodated in a space enclosed by a box case 10 and box cover 15, which are integrated.

As shown in FIG. 2, the box case 10 has a concave part 11 that can accommodate an electromagnet block 30, which will be described later, and includes fixing through-holes 12 at a pair of diagonal corners of the plane and connecting concaves 13 at remaining corners of the plane. A strengthening tube body 12*a* is press-fitted into each of the through-hole 12, and a connecting nut 13*a* is fitted into each of the connecting concaves 13.

The box cover 15 has a form that can be fitted into the box case 10 and can accommodate a sealing case block 40, which will be described later. Furthermore, the ceiling surface of the box cover 15 has connecting holes 16 and 16 through which the connecting terminals 75 and 85, which will be described later, of the relay body 20 project. Furthermore, projections 17 and 17, which can accommodate a venting pipe 21, project from the ceiling surface of the box cover 15. The projections 17 and 17 are connected through a partition 18, and they also function as an insulating wall. Associating holes 19 at the lower opening edges of the box cover 15 are associated with associating nails 14 at the upper opening edges of the box case 10 so that both of them can be bonded and integrated.

Figure 3:
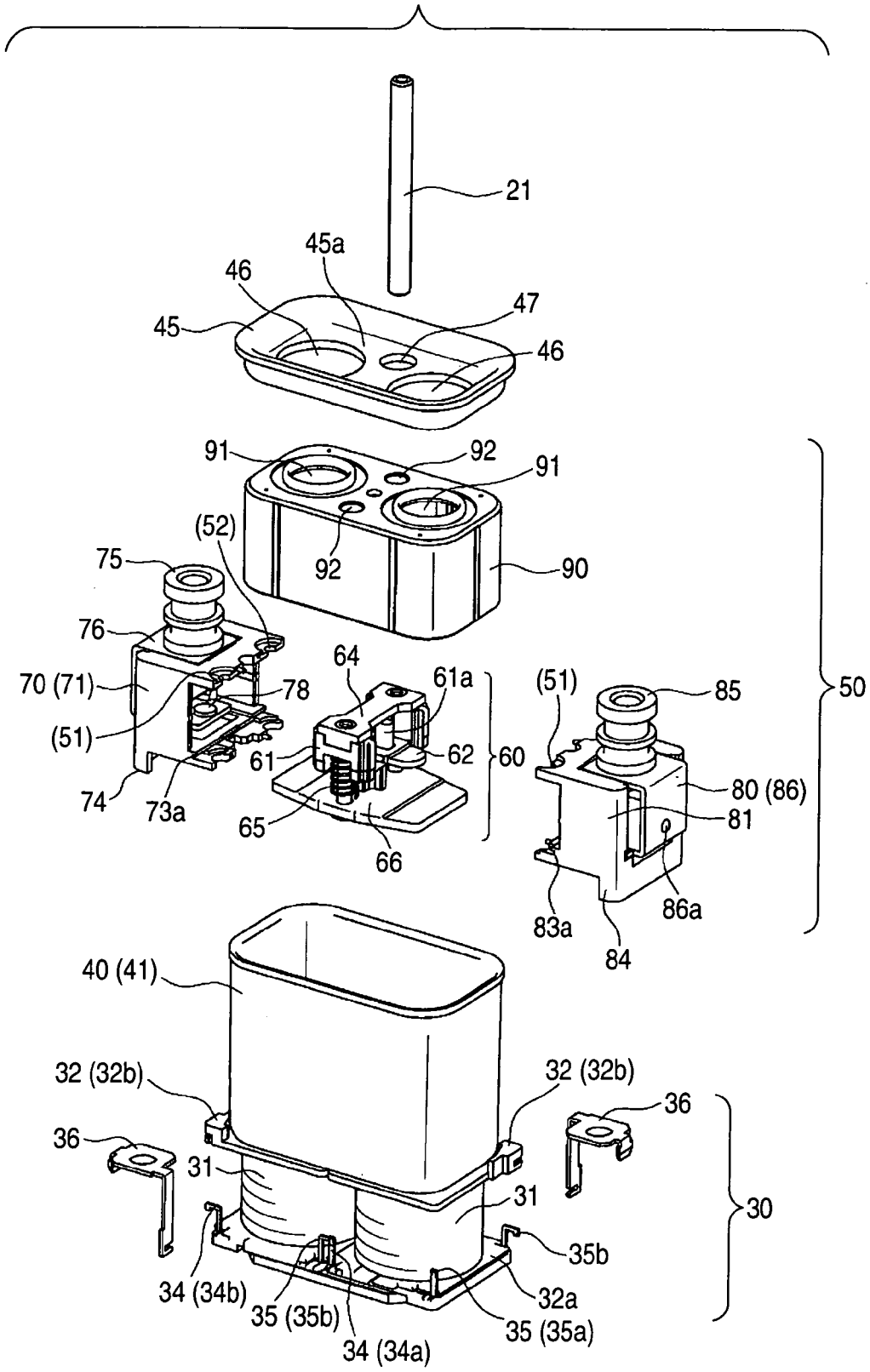
FIG. 3 is an exploded perspective view of a relay body shown in FIG. 2.

As shown in FIGS. 2 and 3, in the relay body 20, a contact mechanism block 50 is sealed within the sealing case block 40 mounted on the electromagnet block 30.

Figure 4:
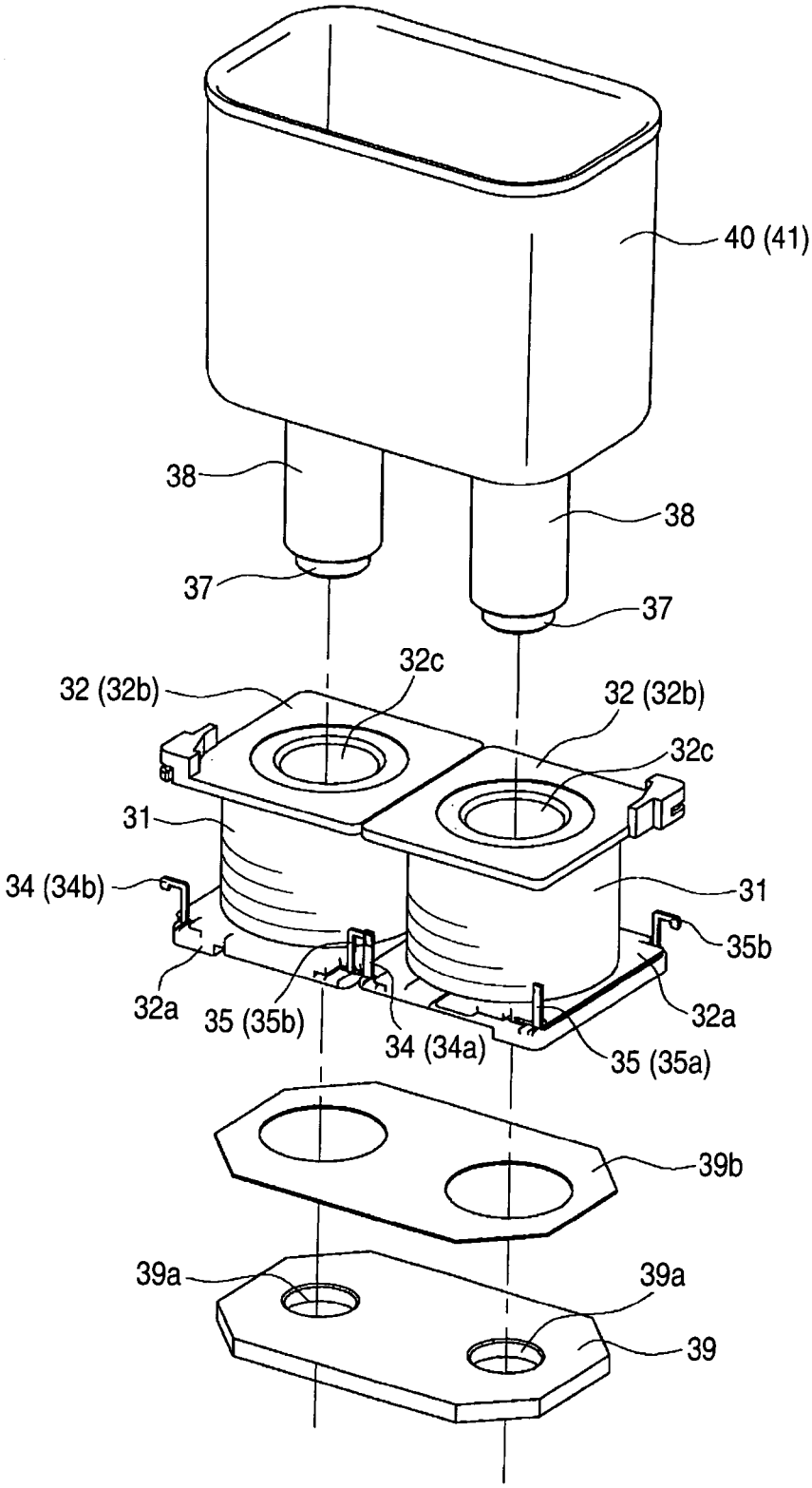
FIG. 4 is an exploded perspective view of an electromagnet block shown in FIG. 3.
Figure 5:
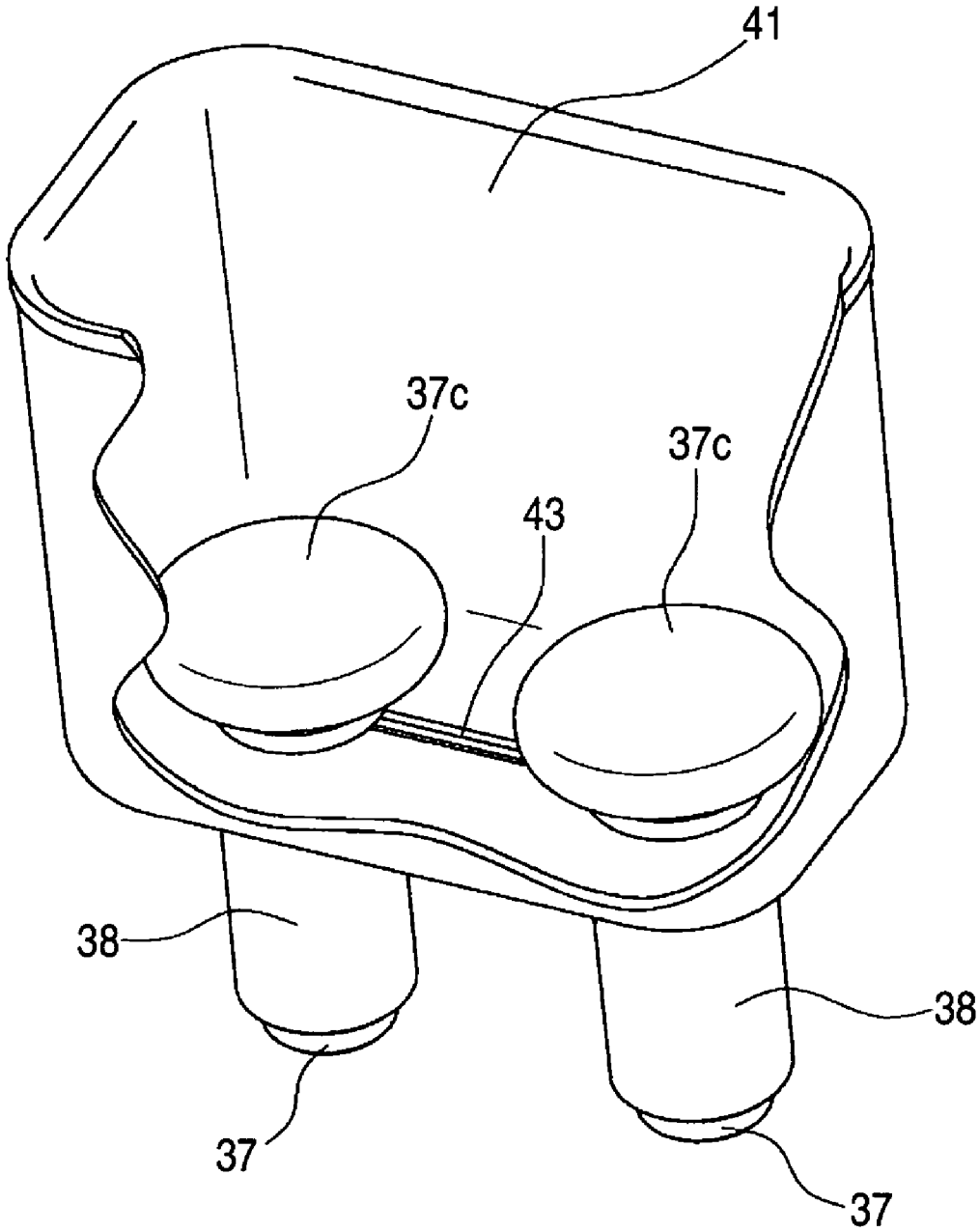
FIG. 5 is a partially cutaway perspective view of a sealing case shown in FIG. 4.

As shown in FIG. 4, spools 32 and 32 about which coils 31 are wound are aligned in the electromagnet block 30, and the electromagnet block 30 is integrated through two iron cores 37 and 37 and a plate yoke 39.

Relay terminals 34 and 35 are press-fitted from the sides to facing both end faces of lower collars 32*a* among collars 32*a* and 32*b* at both upper and lower ends of the spools 32. Moreover, one end of each of the coils 31 wound about the spools 32 is wound about and soldered to one end (winding portion) 34*a* of the one relay terminal 34 while the other end is wound about and soldered to one end (winding portion) 35*a* of the other relay terminal 35. The relay terminals 34 and 35 bend and raise the winding portion 34*a* as well as the other end (connecting portion) 35*b*. Then, between the relay terminals 34 and 35 assembled to the aligned spools 32 and 32, the connecting portion 35*b* of the one relay terminal 35 and the winding portion 34*a* of the other relay terminal 34 are joined adjacently and soldered to each other. Furthermore, the winding portion 35*a* of the one relay terminal 35 and the connecting portion 34*b* of the other relay terminal 34 are adjacently joined and soldered to each other. Thus, the two coils 31 and 31 are connected to each other. Then, coil terminals 36 and 36 are spanned across the upper and lower collars 32*a* and 32*b* of the spools 32 and are connected to the connecting portions 34*b* and 35*b* of the relay terminals 34 and 35 (see FIG. 3).

The sealing case block 40 includes a sealing case 41 and a sealing cover 45. The sealing case 41 can accommodate the contact mechanism block 50, which will be described later. The sealing cover 45 seals an opening part of the sealing case 41. The bottom surface of the sealing case 41 has a pair of press-fit holes 42 into which iron cores 37 can be press-fitted (see FIG. 6). A slit 43 for connecting the press-fit holes 42 and 42 is provided between the press-fit holes 42 and 42. On the other hand, as shown in FIG. 3, the sealing cover 45 includes a pair of through-holes 46 and 46 and a free-fit hole 47 on the bottom surface of a concave part 45*a* of the sealing cover 45. Connecting terminals 75 and 85 of the contact mechanism block 50, which will be described later, can be disposed in the through-holes 46 and 46, and the venting pipe 21 can be freely fitted through the free-fit hole 47.

The electromagnet block 30 and the sealing case 40 can be assembled by following steps.

First of all, the relay terminals 34 and 35 are press-fitted into the one pair of collars 32*a* of the spool 32. Then, the coils 31 are wound about the spools 32, and the lead lines are wound about and soldered to the winding portions 34*a* and 35*a* of the relay terminals 34 and 35. Next, the spools 32 are aligned which bend and raise the winding portions 34*a* and 35*a* and connecting portions 34*b* and 35*b* of the relay terminals 34 and 35. Then, the winding portion 35*a* of the adjacent relay terminal 35 and the connecting portion 34*b* of the other relay terminal 34 are adjacently joined and soldered to each other. Furthermore, the connecting portion 35*b* of the adjacent relay terminal 35 and the winding portion 34*a* of the other relay terminal 34 are adjacently joined and soldered to each other. Thus, the coils 31 and 31 can be connected to each other.

Figure 6:
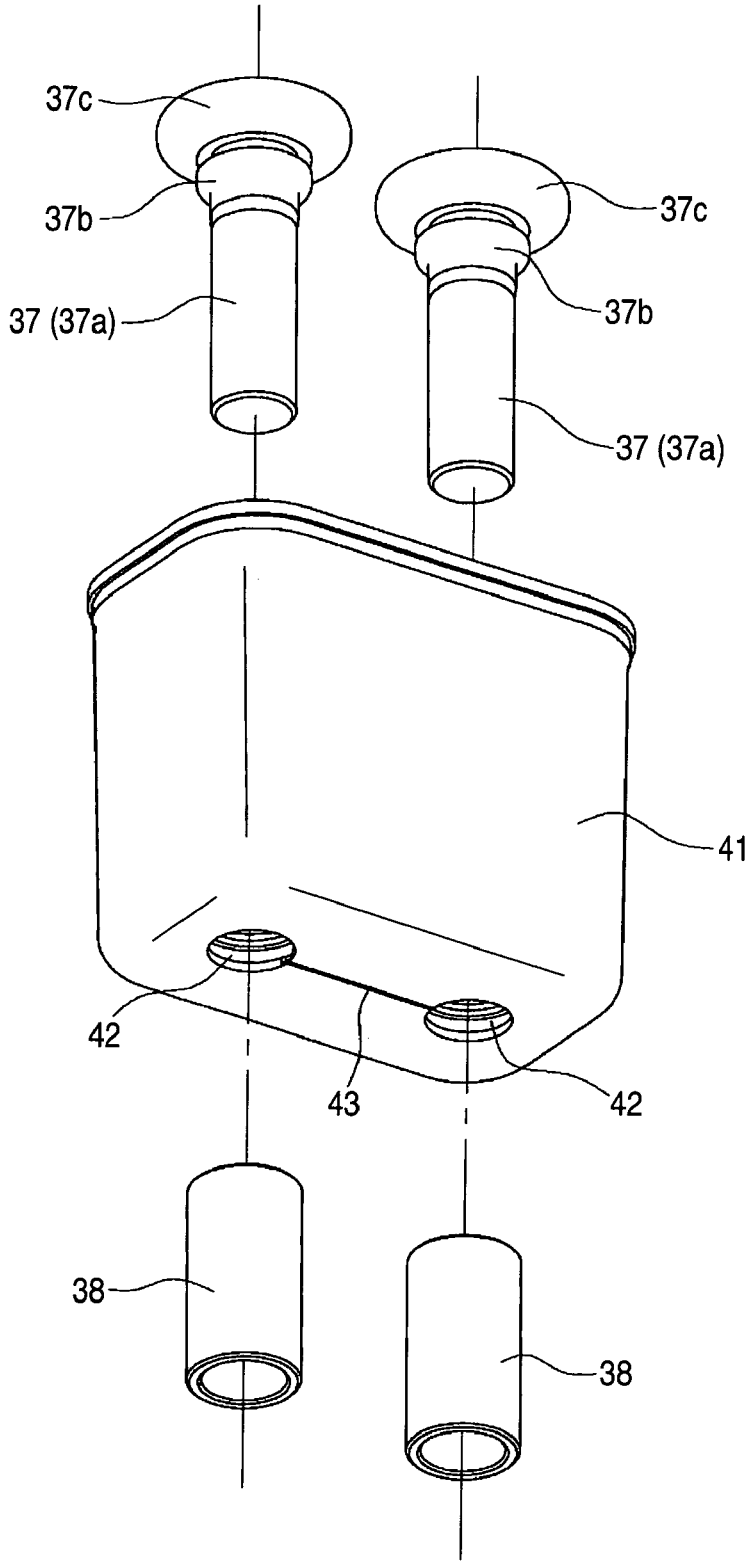
FIG. 6 is an exploded perspective view of the sealing case shown in FIG. 4.

On the other hand, as shown in FIG. 6, the iron cores 37 are inserted into the press-fit holes 42 in the bottom surface of the sealing case 41, and the pipes 38 are fitted into axes 37*a* of the projecting iron cores 37. Then, pressure is applied from the opening edges of the pipes 38 toward the shaft centers of the iron cores 37. The axes 37*a* of the iron cores 37 have a smaller diameter than the diameter of the press-fit holes 42 in the sealing case 41 and inner diameter of the pipes 38. However, the diameter of lower necks 37*b* of the iron cores 37 is larger than the diameter of the press-fit holes 42 in the sealing case 41 and inner diameter of the pipes 38. Thus, when pressure is applied toward the shaft centers of the iron cores 37, the lower necks 37*b* of the iron cores 37 enlarge and are press-fitted into the press-fit holes 42 in the sealing case 41 and enlarge the inner diameter of the pipes 38 and are press fitted into the pipes 38. Furthermore, the opening edges of the pipes 38 and heads (magnetic pole portions) 37*c* of the iron cores 37 are crimped to the opening edges of the press-fit holes 42 vertically. Therefore, the opening edges of the press-fit holes 42 in the sealing case 41 are crimped in three directions.

Since the sealing case 41 is made of a material having a higher thermal expansion coefficient, such as aluminum, than those of the iron cores 37 and pipes 38 according to this embodiment, the hermeticity is not deteriorated even at different temperatures, which is an advantage.

This is because the sealing case 41 is held between the heads 37*c* of the iron cores 37 and the pipes 38 more strongly even when a temperature increases and the parts expand since the expansion of the sealing case 41 in the thick direction is relatively larger than those of the other parts. This is also because the lower necks 37*b* of the iron cores 37 are fastened even when a temperature decreases and the parts contract since, on the other hand, the contraction of the press-fit holes 42 in the sealing case 41 is relatively larger than those of the other parts. Notably, in order to prevent the occurrence of thermal stress with the hermeticity maintained, the iron cores 37 and the pipes 38 preferably have thermal expansion coefficients, which are substantially equal.

When the sealing case 41 is made of aluminum, which is readily machinable, the sealing work can be performed easily, and hydrogen does not easily permeate therethrough, which is another advantages.

Figure 16A:
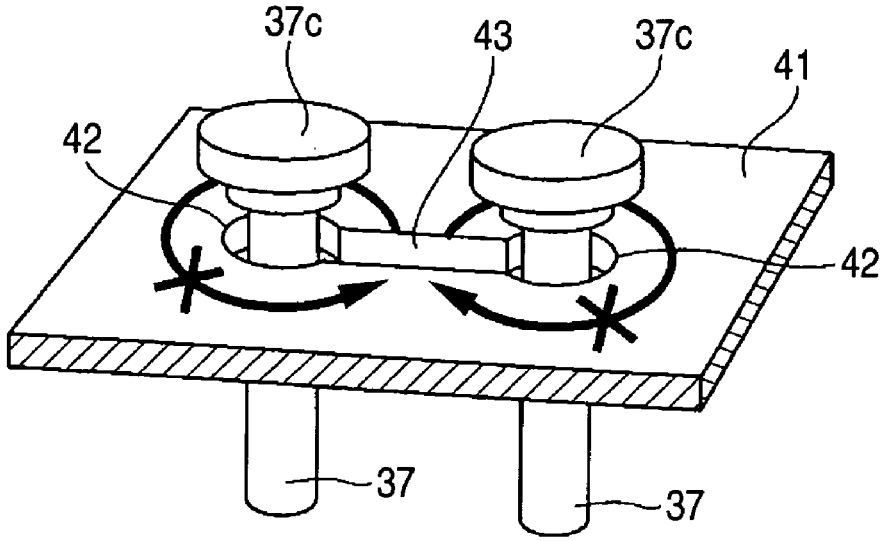
FIG. 16A is a partially perspective view showing an operational principle of the sealing case shown in FIG. 5.
Figure 16B:
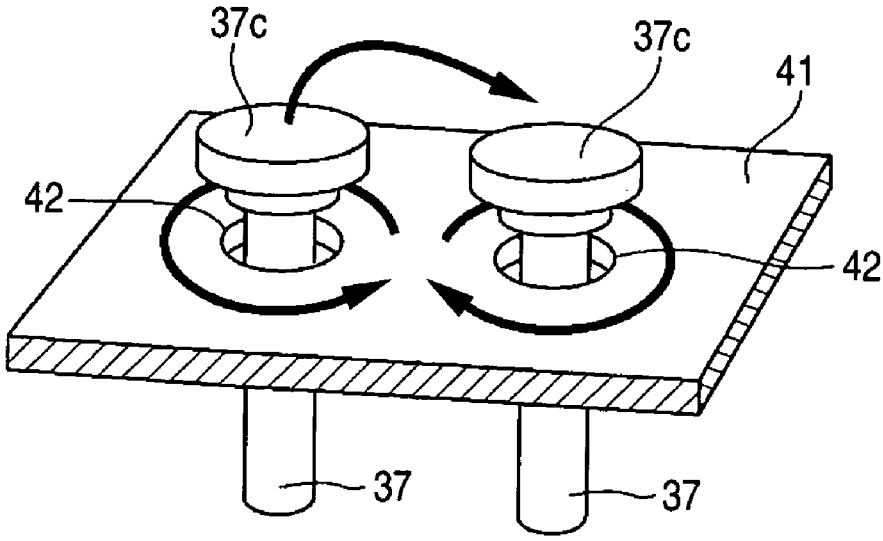
FIG. 16B is a partially perspective view showing an operational principle of a sealing case according to a conventional example.

Furthermore, since the bottom surface of the sealing case 41 has a slit 43 according to this embodiment, the occurrence of eddy current can be prevented even when any changes occur in magnetic fluxes of the iron cores 37 as shown in FIGS. 16A and 16B. Thus, by preventing the occurrence of magnetic fluxes due to the eddy current, loosening a returning operation of a movable iron piece 67, which will be described later, can be prevented. As a result, a decrease in breaking performance due to a delay in return time can be advantageously prevented.

The occurrence of eddy current can be prevented not only by providing the slit 43 connecting the press-fit holes 42 and 42 as described above but also, for example, by providing at least one notch part around each of the press-fit holes 42 and 42 with the notch parts not connected to each other. Parts around the press-fit holes 42 of the bottom surface of the sealing case 41 may have concaves and convexes having different thickness to increase electrical resistance so that the occurrence of eddy current can be suppressed.

Then, as shown in FIG. 4, the iron cores 37 and pipes 38 are inserted to the center holes 32*c* of the spools 32, respectively, and the distal parts of the projecting iron cores 37 are provided, crimped and fixed through crimp holes 39*a* of the yoke 39 so that the electromagnetic block 30 mounting the sealing case 41 can be finished. Notably, an insulating sheet 39*b* is provided between the yoke 39 and the collars 32*a* of the spools 32 in order to enhance the insulating performance.

Next, the coil terminals 36 are spanned across the upper and lower collars 32*a* and 32*b* of the spools 32, respectively, and the lower ends of the coil terminals 36 are connected to the connecting portions 34*b* and 35*b* of the relay terminals 34 and 35 so that the work of assembling the electromagnet block 30 and the sealing case 41 can be finished. Then, a sealant 98 is injected and hardened on the bottom surface of the sealing case 41 and seals the slit 43 thereby. The sealant 98 contains alumina powder in an epoxy resin and has a linear expansion coefficient, which is substantially equal to that of aluminum when hardened.

As shown in FIG. 3, the contact mechanism block 50 includes a movable contact block 60, fixed contact blocks 70 and 80 mounted on both sides of the movable contact block 60, and an insulating case 90 fitted thereto so that the contact mechanism block 50 can be handled as a unit.

Figure 7:
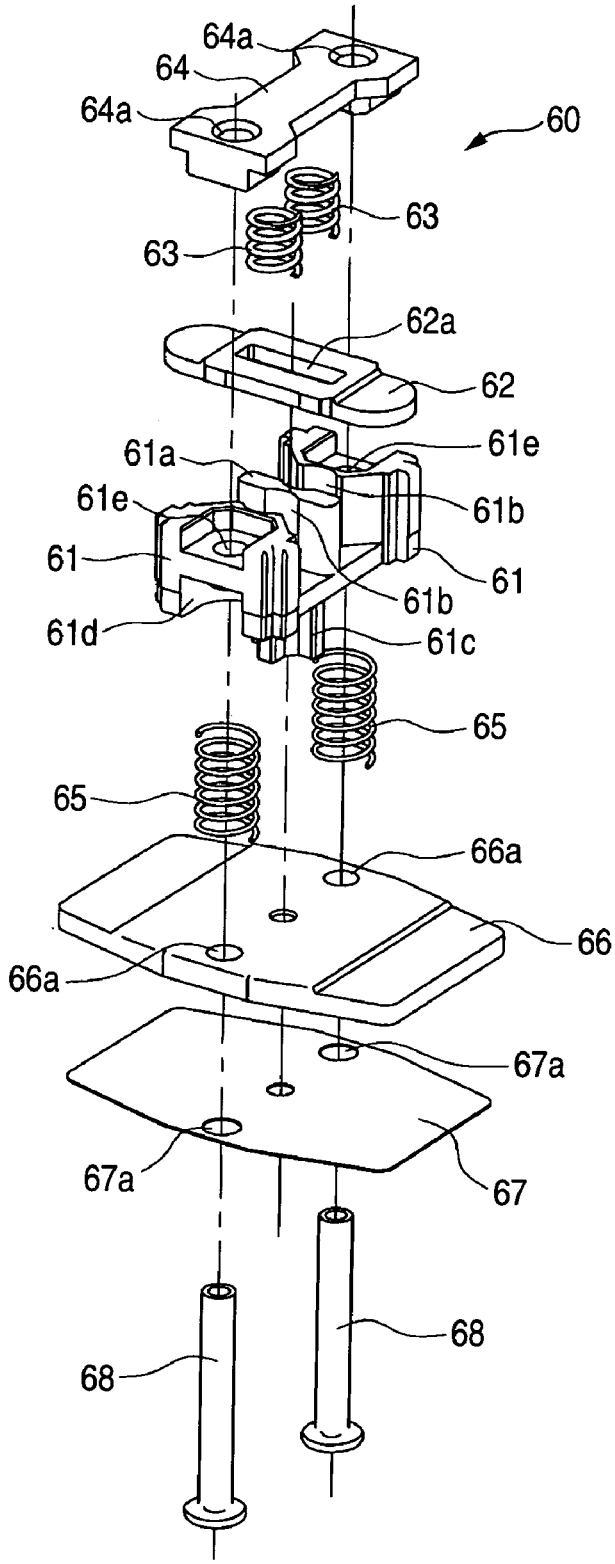
FIG. 7 is an exploded perspective view of a movable contact block shown in FIG. 3.

As shown in FIG. 7, the movable contact block 60 includes a movable contact piece 62 and a pair of contact-pressing coil springs 63 and 63, which are assembled to a movable insulating base 61 through a lock 64. Furthermore, return coil springs 65, a movable iron piece 66 and a magnet shielding plate 67 are crimped to the movable insulating base 61 through a pair of rivets 68 and 68.

The movable insulating base 61 has deep grooves 61*b* and 61*b* on both sides of a guide projection 61*a* that projects from the top surface at the center of the movable insulating base 61. The deep grooves 61*b* and 61*b* can accommodate the coil springs 63 not to fall off. Furthermore, the movable insulating base 61 has a foot 61 projecting from the center of the lower surface of the movable insulating base 61 and has concaves 61*d* and 61*d* (where the concave 61*d* at the back is not shown) in the ceiling surface on both sides of the movable insulating base 61. The foot 61*c* has a section in a substantially cross form. The concaves 61*d* and 61*d* position the return coil springs 65.

The movable contact piece 62 is a thick, band-shaped conductive material having half-round ends and has a guiding long hole 62*a* at the center. On the other hand, the coil springs 63 give contact pressure to the movable contact piece 62 and forces the movable contact piece 62 downward at all times.

Therefore, in order to assemble the movable contact block 60, the guiding long hole 62*a* in the movable contact piece 62 is fitted to the guiding projection 61*a* of the movable insulating base 61 first. Then, the pair of coil springs 63 and 63 is fitted to the deep grooves 61*b* and 61*b* and is positioned by mounting the lock 64 thereto. Furthermore, the rivets 68 and 68 extending through the crimp holes 66*a* in the movable iron piece 66 and through the crimp holes 67*a* in the magnet-shielding plate 67 are inserted into the return coil springs 65 and 65 positioned at the concaves 61*d* and 61*d* in the movable insulating base 61. Then, the rivets 68 through the crimp holes 61*e* and 61*e* in the movable insulating base 61 and the crimp holes 64*a* in the lock 64 are crimped and integrated so that the assembly work can be completed. According to this embodiment, the movable contact piece 62 is always forced downward by spring force of the coil springs 63 and does not shake.

Figure 8:
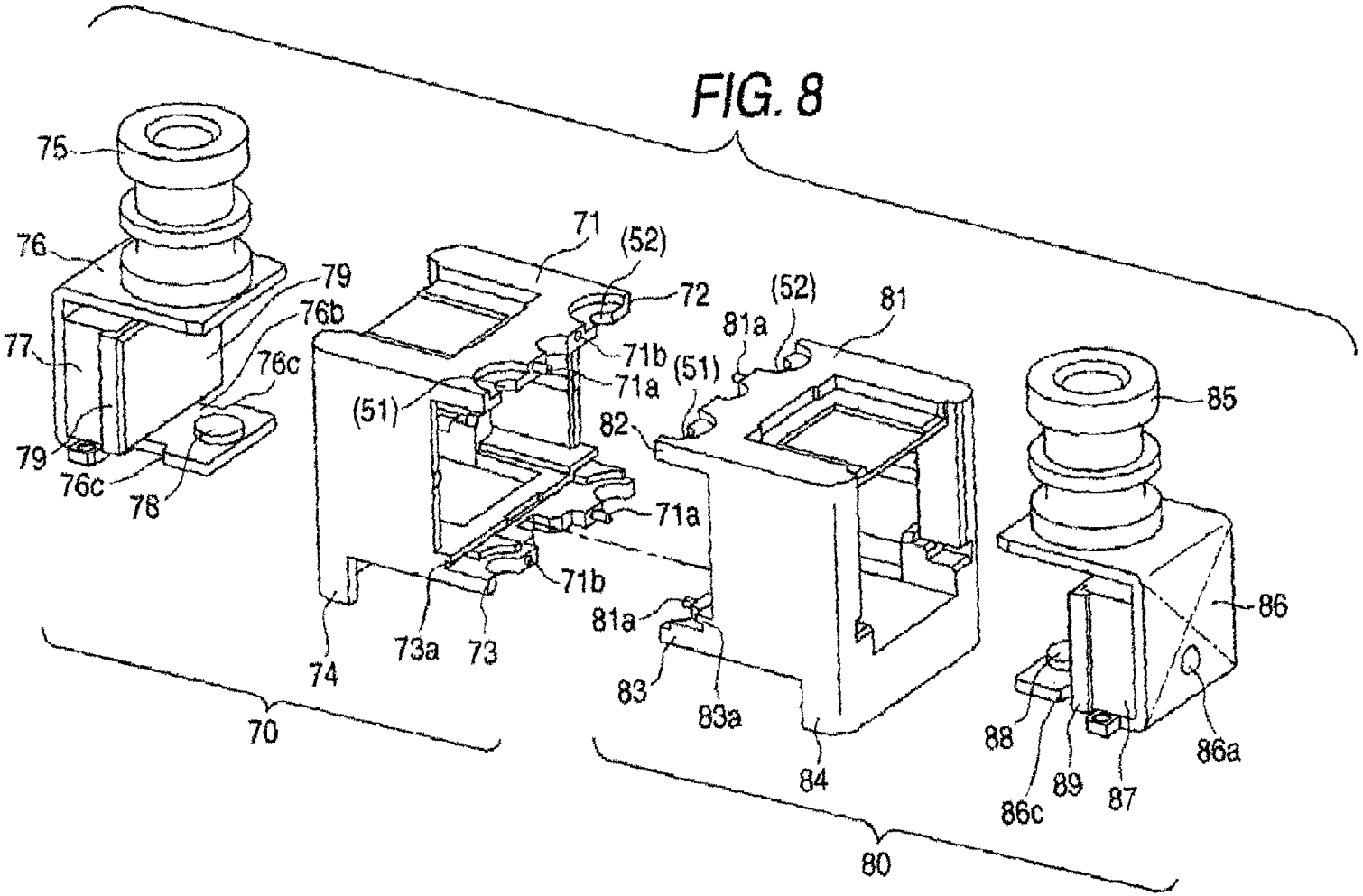
FIG. 8 is an exploded perspective view of a fixed contact block shown in FIG. 3.
Figure 9B:
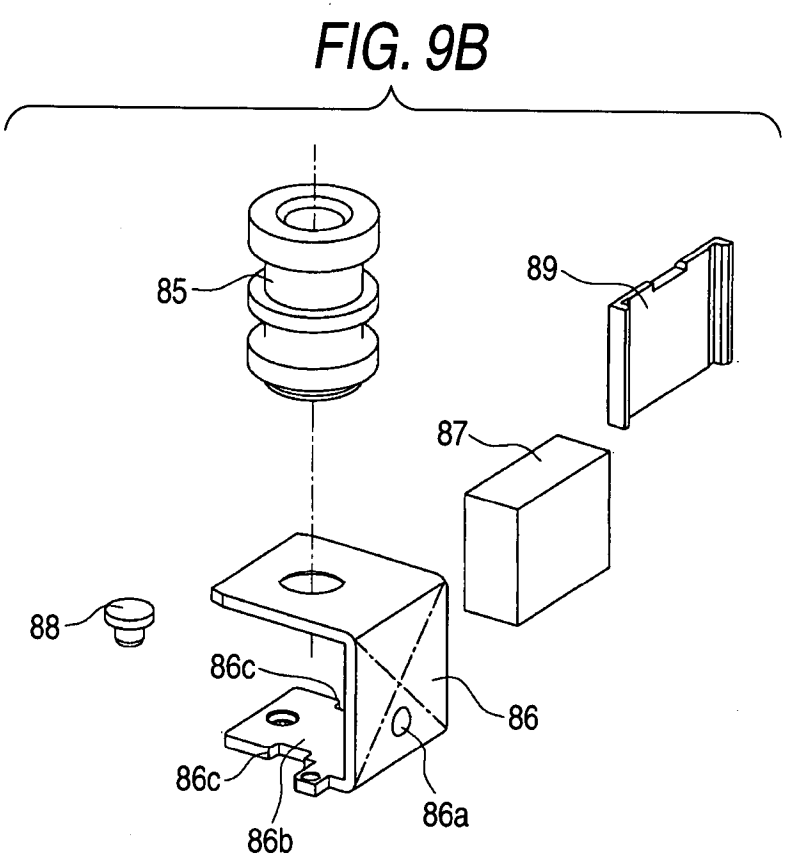
FIGS. 9A and 9B are exploded perspective views each illustrating the main part of the fixed contact block shown in FIG. 8.
Figure 9A:
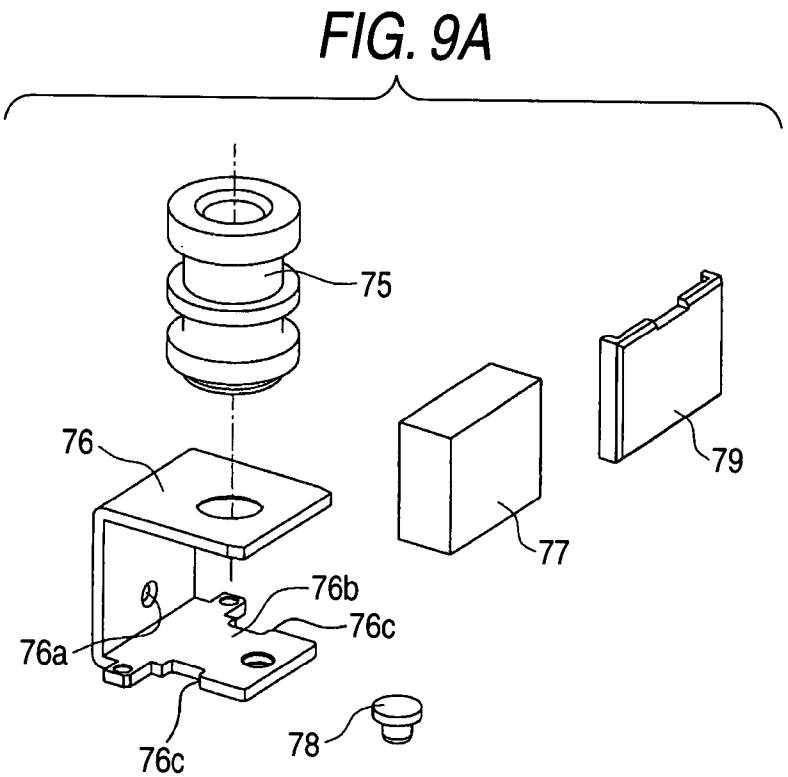

As shown in FIGS. 8 and 9, the fixed contact blocks 70 and 80 have an identical form and an identical structure, and fixed contact terminals 76 and 86 and permanent magnets 77 and 87 are mounted to fixed contact bases 71 and 81, which are molded resins. Each of the fixed contact terminals 76 and 86 has a substantially C-shaped section, and connecting terminals 75 and 85 are crimped to the fixed contact terminals 76 and 86.

Figure 14:
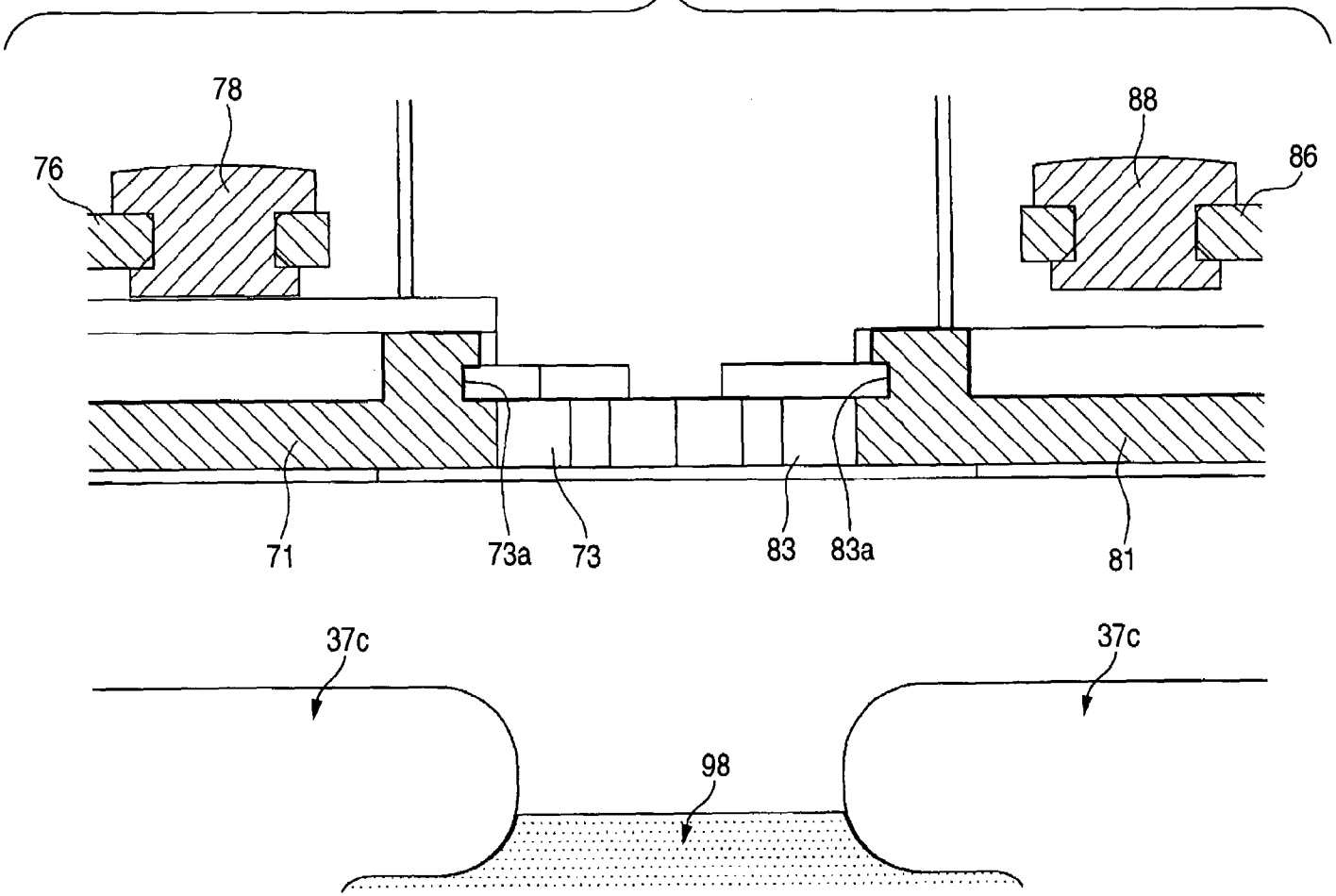
FIG. 14 is an enlarged section view of the main part of the direct current shutting relay shown in FIG. 12.
Figure 15:
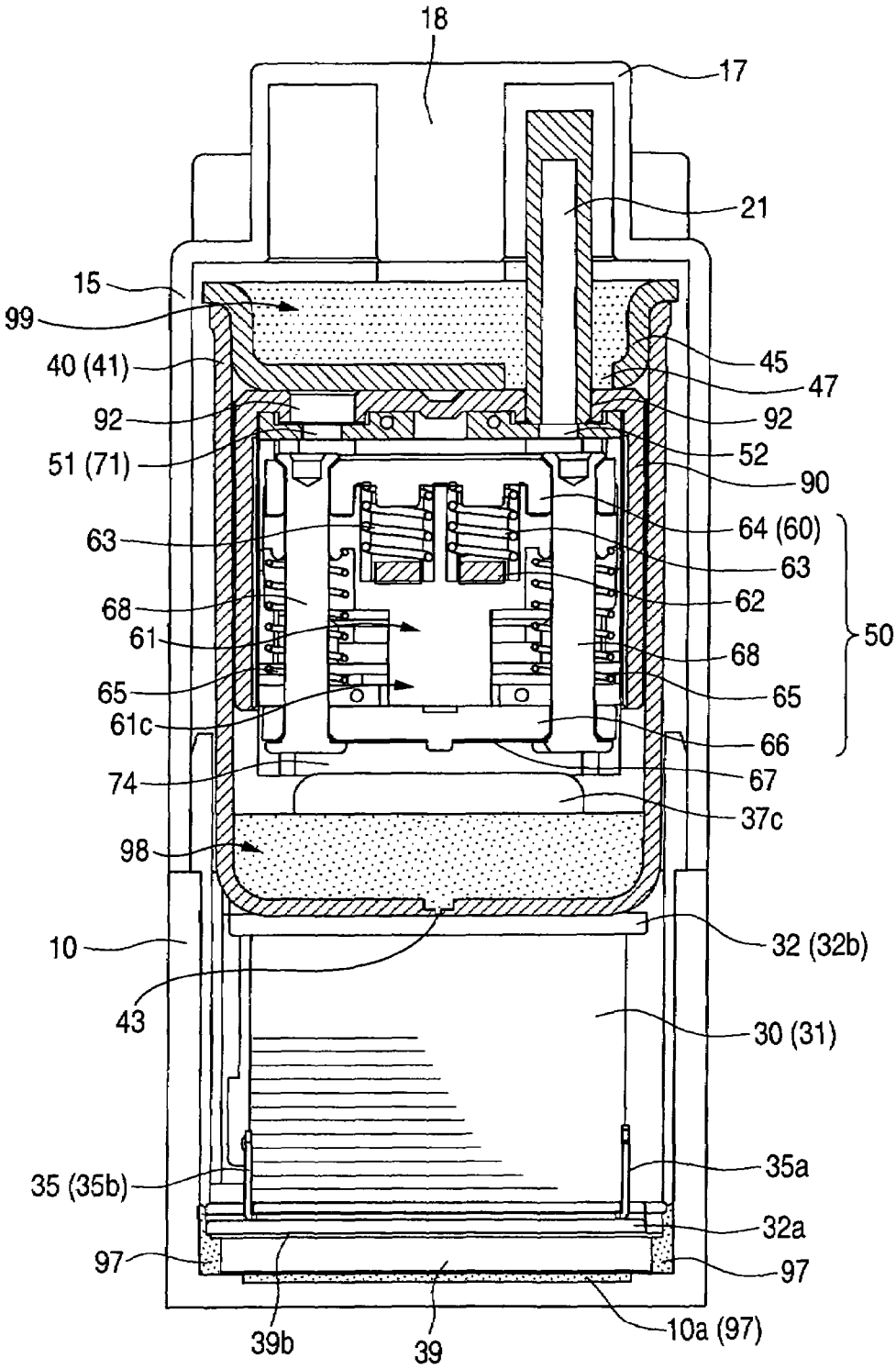
FIG. 15 is a longitudinal sectional view of a side of the direct current shutting relay shown in FIG. 1.

The fixed contact bases 71 and 81 have butt projections 72 and 73 and 82 and 83 at the upper and lower edges of facing surfaces. Especially, the projections 72 and 73 and 82 and 83 have fit projections 71*a* and 81*a*, which can be fitted to each other, and holes 71*b* and 81*b* in the distal surfaces. Furthermore, as shown in FIG. 14, the projections 73 and 83 have notch grooves 73*a* and 83*a* at the upper base so that insulating grooves having substantially inverted-T shaped sections can be attained. This is for preventing establishment of a short circuit since, even when contact flying powder caused upon contact switching flies to the inner surface, the contact flying powder cannot adhere to the inner corners of the notch grooves 73*a* and 83*a*. Notably, both of the notch grooves 73*a* and 83*a* are not always required, but one of them may be provided to have an insulating groove having a substantially L-shaped section.

As shown in FIGS. 8 to 9B, the fixed contact terminals 76 and 86 have fixed contact portions 78 and 88 crimped at the distal parts of the lower sides and have the permanent magnets 77 and 87 mounted at the corners of the lower sides. Furthermore, the fixed contact terminals 76 and 86 have locating projections 76*a* and 86*a* resulting from ejection processing on the slightly lower sides from the centers of the square outward surfaces. The projections 76*a* and 86*a* are pressure-welded to the inner circumference of the insulating case 90, which will be described later, (see FIG. 13) and locate the fixed contact terminals 76 and 86 so that the precision of the positioning of the fixed contacts 78 and 88 can be enhanced. The fixed contact terminals 76 and 86 have narrow parts 76*b* and 86*b* at the positions between the fixed contact portions 78 and 88 and the permanent magnets 77 and 87, respectively. This is for preventing movement of the arc current sources toward the permanent magnets 77 and 87 by having corner parts 76*c* and 86*c* before the permanent magnets 77 and 87, respectively.

Figure 10A:
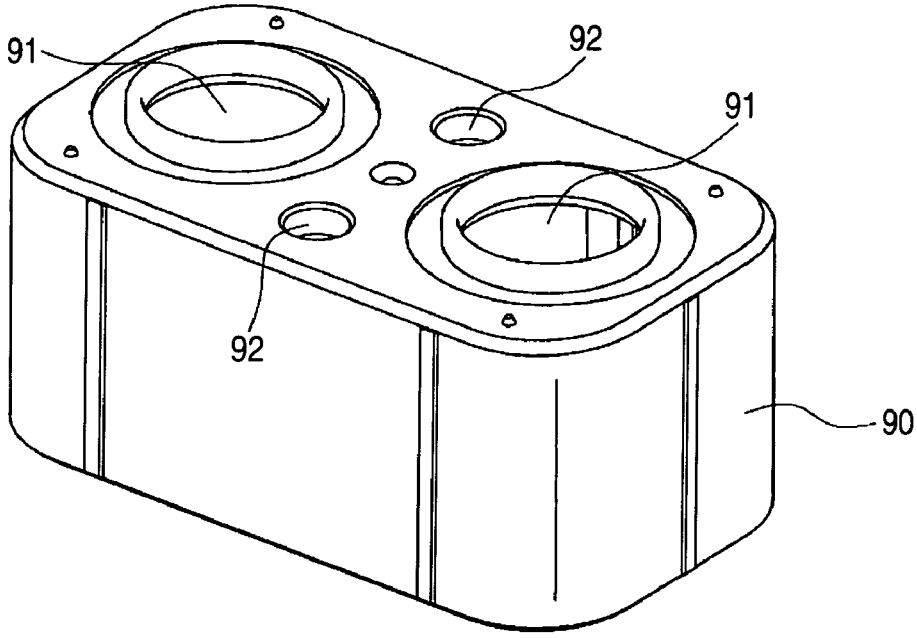
FIG. 10A is a perspective view of an insulating case shown in FIG. 3.
Figure 10B:
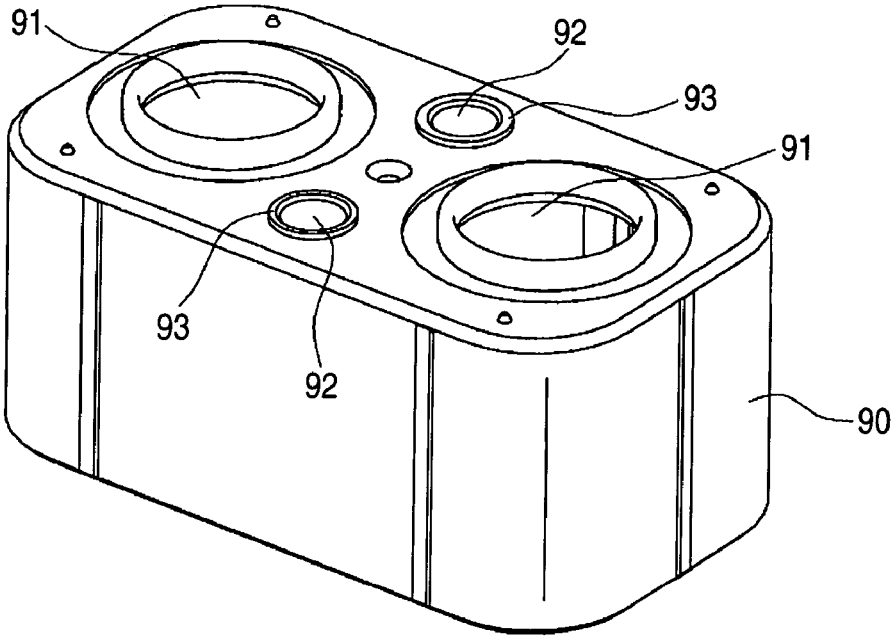
FIG. 10B is a variation example of the insulating case.
Figure 11A:
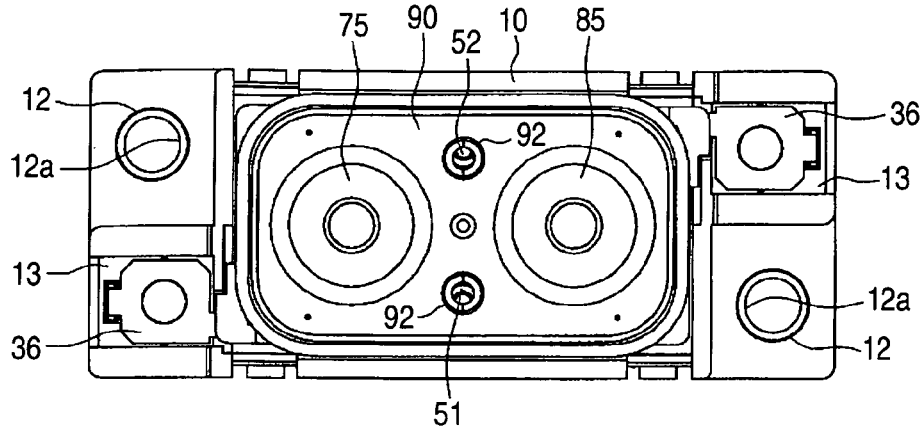
FIGS. 11A to 11C are plan views illustrating sealing steps.
Figure 11B:
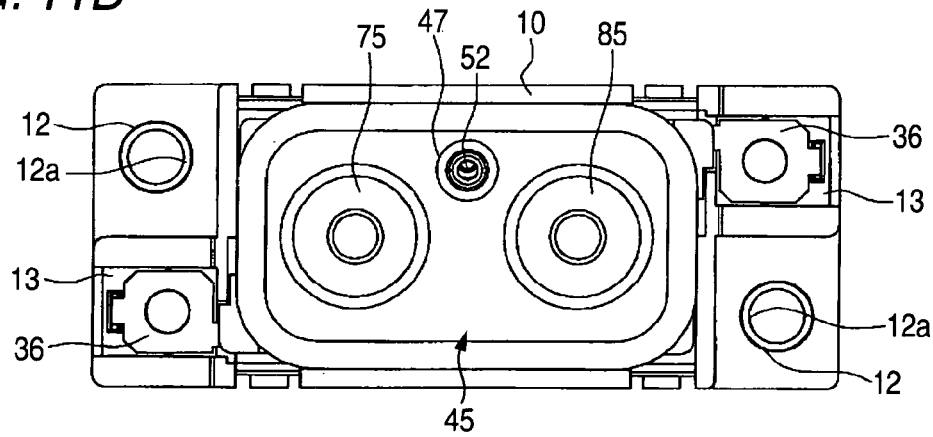
Figure 11C:
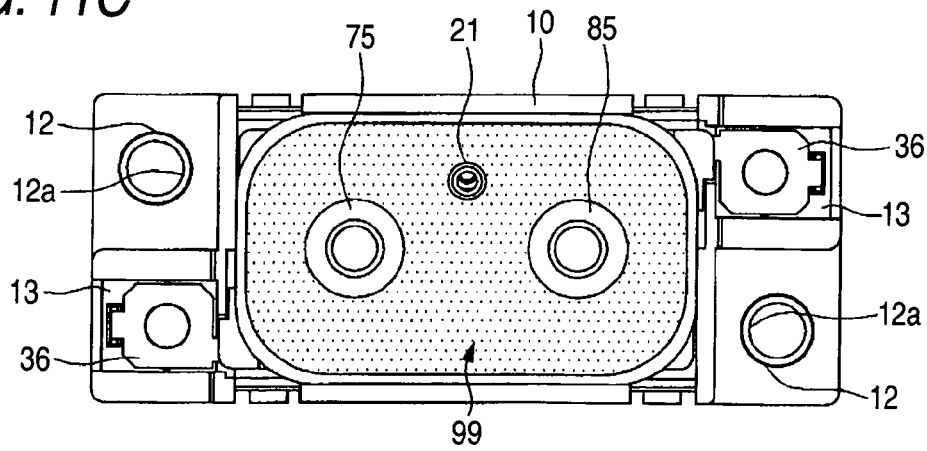

As shown in FIG. 3, the insulating case 90 allows the contact mechanism block 50 to be handled as a unit. The insulating case 90 has a pair of venting holes 92 and 92 symmetrically on both sides of the center line connecting terminal holes 91 and 91 on the top surface (see FIGS. 3 and 10A). The symmetrically provided venting holes 92 can eliminate orientation in assembling. Furthermore, a ring-shaped projection 93 for preventing the invasion of a sealant may be integrated to the opening edges of the venting holes 92 (FIG. 10B).

Next, steps of assembling the contact mechanism block 50 will be described.

First of all, the fixed contact blocks 70 and 80 are assembled thereto from both sides of the movable insulating base 61 with the lower ends of the return springs 65 of the mounted movable contact block 60 lifted, and the hole 81*b* and projection 81*a* of the butt projections 82 and 83 are fitted to and butted against the projection 71*a* and hole 71*b* of the butt projections 72 and 73. Thus, the fixed contact bases 71 and 81 can have operating holes 51 and 52 therebetween. Furthermore, the insulating case 90 is fitted to the fixed contact blocks 70 and 80 so that the connecting terminals 75 and 85 can project from the terminal holes 91 and 91, respectively, and the contact mechanism block 50 can be finished. Here, the venting holes 92 and 92 and the operating holes 51 and 52 are coaxially positioned and communicated (see FIG. 15).

Next, when the contact mechanism block 50 is inserted to the sealing case 41 mounted to the electromagnet block 30 (see FIG. 12), the foot parts 74 and 84 of the fixed contact bases 70 and 80 are abutted to the head parts 37*c* serving as magnetic pole portions of the iron cores 37, respectively, and the movable iron piece 66 faces toward the magnetic pole portions 37*c* through the magnet shielding plate 67 such that the movable iron piece 66 can touch and leave the magnetic pole portions 37*c*. Then, a pair of measuring probes (not shown) is inserted through venting holes 92 and 92 of the insulating case 90 and operating holes 51 and 52 between the fixed contact bases 71 and 81. Next, the rivets 68 and 68 crimped to the lock 64 are pressed and released so that operational characteristics of contact pressure, contact gap and so on can be measured by vertically moving the movable contact block 60. As a result, when the operational characteristics do not fall in allowable ranges, slight adjustment can be performed thereon. When the operational characteristics fall in the allowable ranges, the sealing cover 45 is fitted, welded and integrated to the sealing case 41 (see FIG. 11B). Furthermore, the venting pipe 21 is press-fitted into the venting hole 92 of the insulating case 90 from the free-fit hole 47. Then, the same sealant 99 as the sealant 98 containing an epoxy resin is injected and hardened on the sealing cover 45 so that the parts around the bases of the connecting terminals 75 and 85 and venting pipe 21 can be sealed (see FIG. 1C). Then, after the air within the sealing case 40 is purged from the venting pipe 21 and predetermined mixed gas is injected thereto, the venting pipe 21 is crimped and sealed thereto. Finally, the coil terminals 36 are spanned and mounted across the pair of collars 32*a* and 32*b* of the spools 32 so that the relay body 20 can be finished (see FIG. 2).

According to this embodiment, one of the venting holes 92 can be sealed by the venting pipe 21, and the other venting hole 92 is covered by the sealing cover 45. Thus, even when the sealant 99 is injected thereto, the sealant 99 does not invade into the insulating case 90. Furthermore, since the free-fit hole 47 into which the pipe 21 is to be inserted is evenly away from the connecting terminals 75 and 85, a good insulation characteristic can be advantageously attained.

Next, a liquid elastic material 97 containing an urethane resin is injected on the bottom surface of the concave part 11 of the case 10, and the relay body 20 is accommodated in the concave part 11. The coil terminals 36 are positioned at the connecting concaves 13, and the liquid elastic material 97 is hardened with the relay body 20 hung within the case 10. Then, the cover 15 is assembled to the case 10 so that the direct current breaking relay can be finished. While, according to this embodiment, the injected and hardened liquid elastic material 97 serves as a noise-absorbing elastic material, the invention is not always limited thereto. An elastic sheet may be used as a sound-absorbing elastic material. Alternatively, the collar 32*b* of the spool 32 may be extended and hung within the concave part 11 of the case 10.

Next, a relay operation in the above-described construction will be described.

Figure 12:
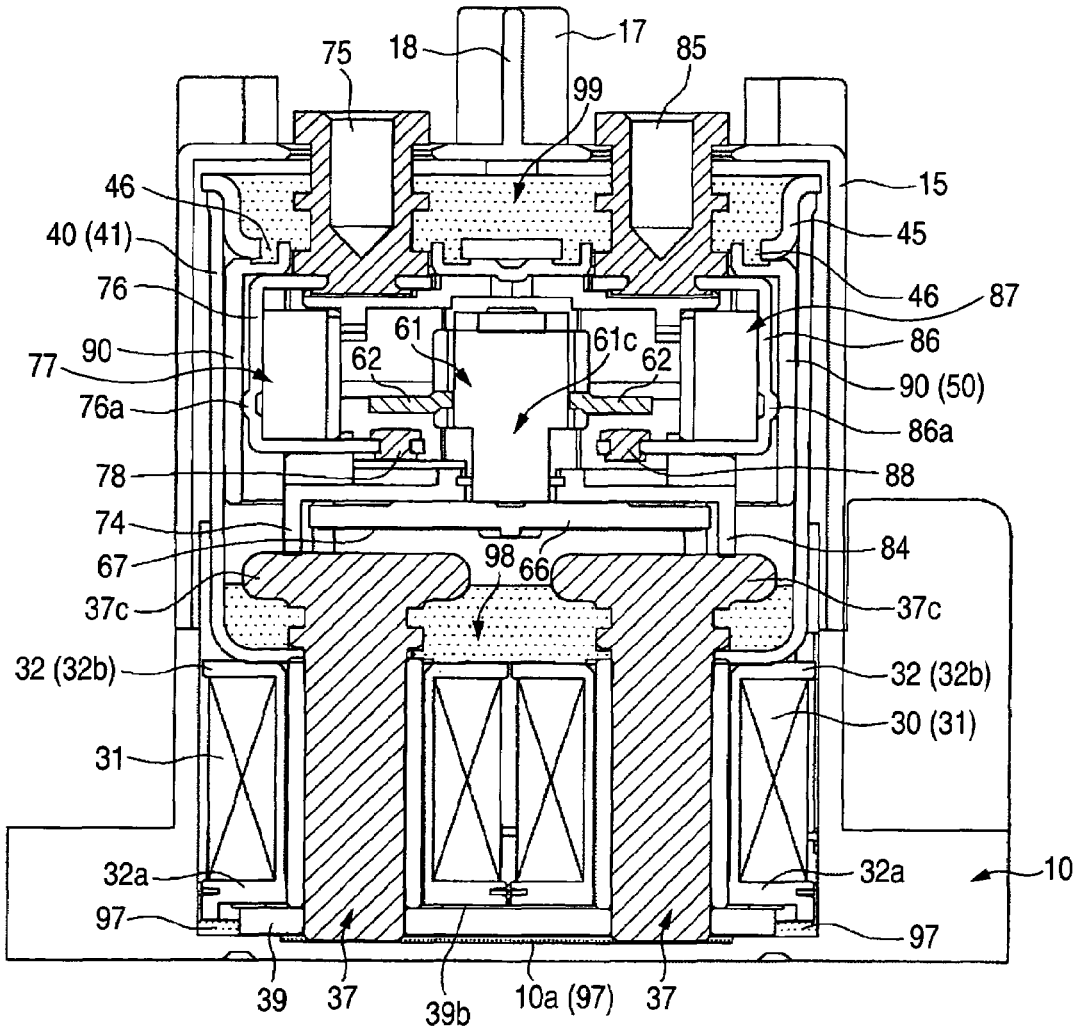
FIG. 12 is a front longitudinal section view of the direct current shutting relay shown in FIG. 1.
Figure 13:
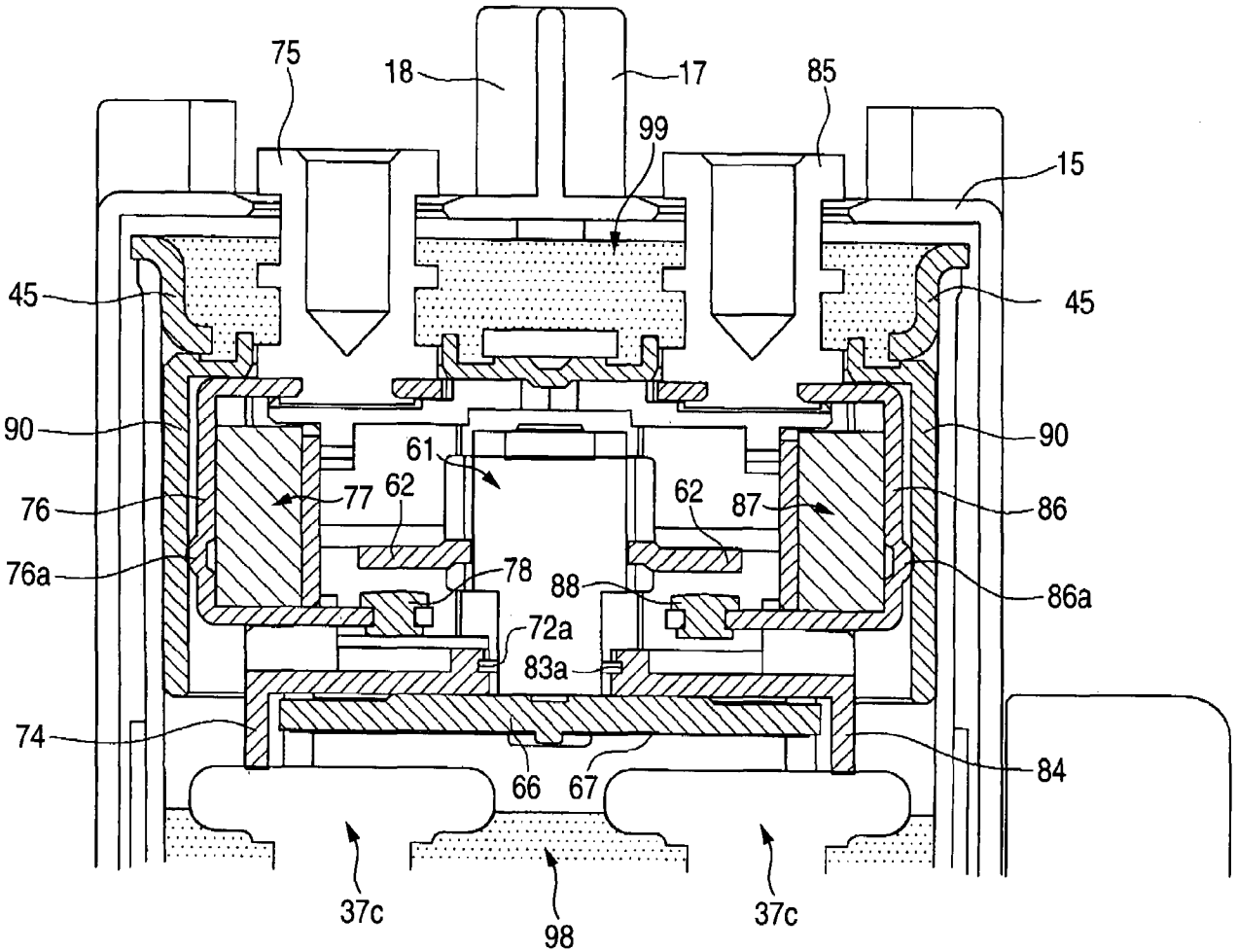
FIG. 13 is a partially enlarged section view of FIG. 12.

First of all, when voltage is not applied to the coils 31 of the electromagnet block 30, the movable insulating base 61 can be pressed up by spring force of the return springs 65 and 65 (see FIG. 12). Thus, the movable iron piece 66 is apart from the magnetic pole portions 37*c* of the iron cores 37, and both ends of the movable contact pieces 62 are apart from the fixed contact portions 78 and 88.

Then, when voltage is applied to the coils 31, the magnetic pole portions 37*c* of the iron cores 37 attracts the movable iron piece 66, and the movable iron piece 67 falls down against spring force of the return springs 65. Thus, after the movable insulating base 61 integrated to the movable iron piece 66 falls down and both ends of the movable contact pieces 62 touch the fixed contacts portions 78 and 88, the movable iron piece 66 is absorbed to the magnetic pole portions 37*c* of the iron cores 37.

According to this embodiment, the hardened liquid elastic materials 97 and the coil terminals 36 absorb and mitigate an impact force caused when the movable iron piece 66 abuts to the magnetic pole portions 37*c* of the iron cores 37, and the occurrence of impact noise can be suppressed. Thus, a silent electromagnetic relay can be advantageously provided.

Next, when the application of voltage to the coils 31 is stopped, the movable insulating base 61 is pressed up by spring forces of the return springs 65. Then, after the movable iron piece 66 integrated to the movable insulating base 61 leaves the magnetic pole portions 37*c* of the iron cores 37, both ends of the movable contact piece 63 leaves the fixed contact portions 78 and 88.

When both ends of the movable contact piece 62 touch and leave the fixed contact portions 78 and 88, the contact flying powder flies toward the inner surfaces of the fixed contact bases 71 and 81. However, since, according to this embodiment, the inner surfaces of the fixed contact bases 71 and 81 indicated by solid lines in FIG. 14 have the notch grooves 73*a* and 83*a*, the contact flying power cannot continuously adhere thereto, advantageously preventing a short circuit.

Figure 17A:
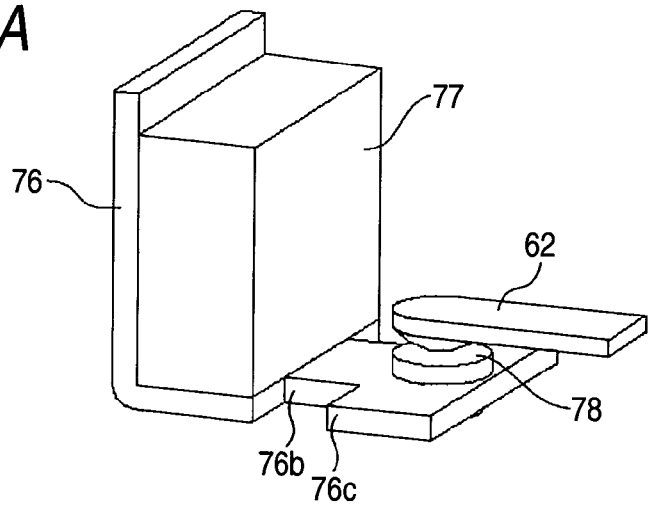
FIGS. 17A to 17C are partially perspective views showing movement of a source of arc current according to an embodiment.
Figure 17B:
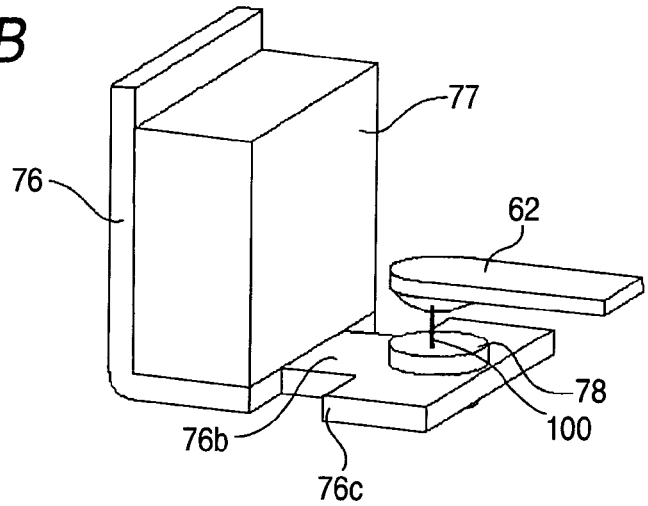
Figure 17C:
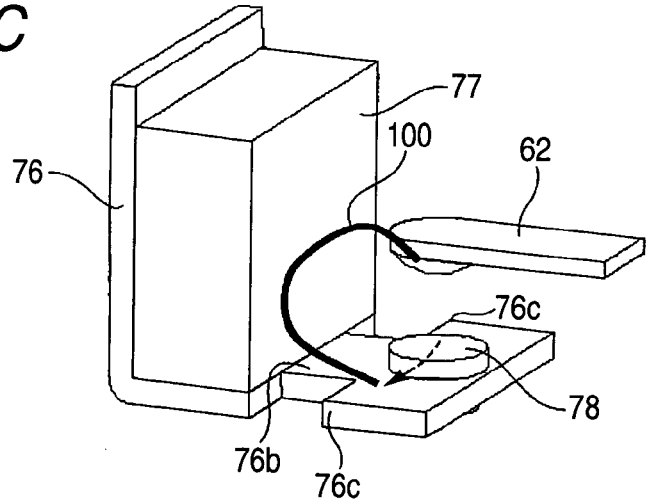
Figure 18A:
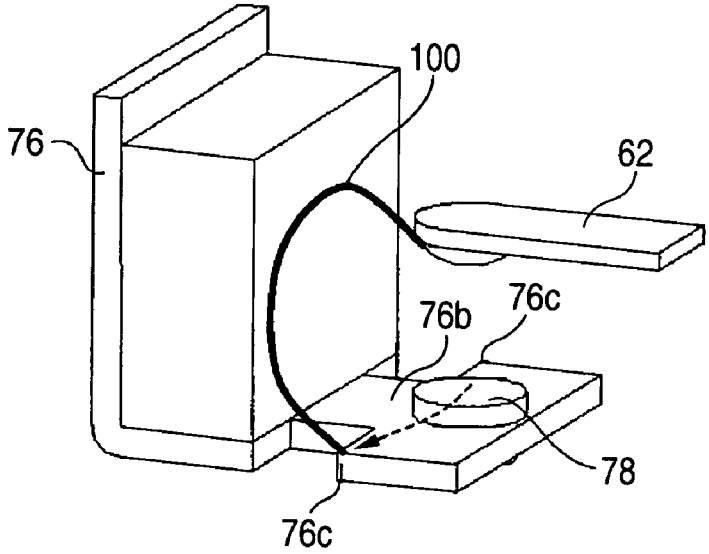
FIG. 18A is a partially perspective view showing movement of the source of arc current which is subsequent to FIG. 17C
Figure 18B:
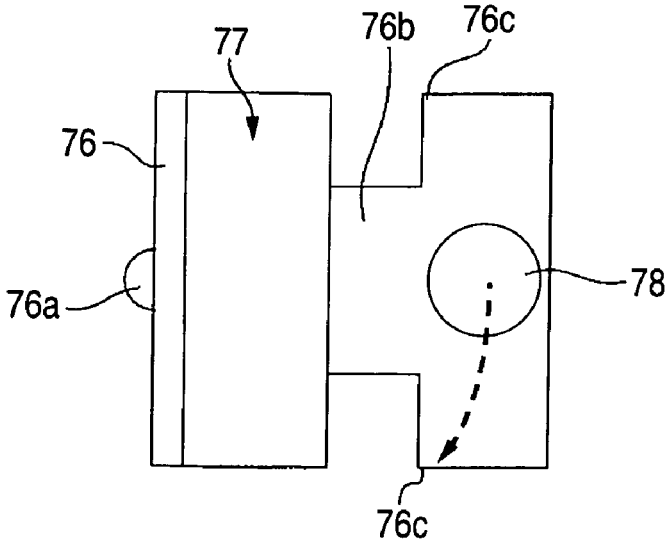
FIG. 18B is a plan view showing the movement of the source of arc current.

When both ends of the movable contact piece 62 leaves the fixed contact portions 78 and 88, arc current 100 is generated from the fixed contact portion 78 and is extended as shown in FIGS. 17A to 17C. Thus, movement of the source of the arc current 100 cannot move the permanent magnet 77, which does not deteriorate the permanent magnet 77 advantageously.

In other words, as shown in FIGS. 17A to 17C, when the arc current 100 is generated from the fixed contact portions 78 (see FIG. 17B), and even when the source of the arc current 100 is pulled and moved by magnetic force of the permanent magnet 77 (see FIGS. 17C, 18A and 18B), the permanent magnet 77 is not moved. This is because of the characteristic that the source of the arc current 100 moves to the edge or corner of a conductive material. Furthermore, according to this embodiment, the narrow part 76*b* extends between the fixed contact portion 78 and the permanent magnet 77 so that the corner part 76*c* can lie before the permanent magnet 77. Thus, the source of the arc current 100 can be moved to the corner part 76*c* only, and the permanent magnet 77 cannot be moved.

This embodiment is the case for breaking direct current, but the invention is not limited thereto. The invention may be applied to a case for breaking alternate current.

The invention is not limited to the above-described electromagnetic relay but is apparently applicable to other electromagnetic relays.

What is claimed is:

1. An electromagnetic relay, comprising:

an electromagnet block having coils wound about the bodies of spools through which iron cores are provided, the electromagnet block being accommodated in a concave part that opens upward of a box-shaped case such that the shaft centers of the iron cores can be orthogonal to the bottom surface of the box-shaped case, the electromagnet block being excited and demagnetized by the passage and break through electric current to the coils so that a contact mechanism can be driven by a movable iron piece that is absorbed to and leaves magnetic pole portions at the upper ends of the iron cores, wherein each spool is provided with a lower collar and upper collar at the lower and upper ends of the spool respectively, wherein the electromagnet block is hung at the upper opening edge of the box-shaped case such that a space can be provided between the bottom surface of the box-shaped case and the electromagnet block, wherein the electromagnet block is hung at the upper opening edge of the box-shaped case through coil terminals at the collars of the spools, wherein the coil terminals span across the upper and lower collars of each spool; and a plurality of relay terminals placed at diagonal corners of the lower collar.

2. An electromagnetic relay according to claim 1, wherein a sound-absorbing elastic material that absorbs and mitigates impact noise is filled in the space between the bottom surface of the box-shaped case and the electromagnet block.

3. An electromagnetic relay according to claim 1, wherein the electromagnet block has a pair of aligned iron cores connected by a yoke spanned across the lower ends of the iron cores.

4. An electromagnetic relay according to claim 1, wherein a sound-absorbing elastic material that absorbs and mitigates impact noise is filled in the space between the bottom surface of the box-shaped case and the electromagnet block.

5. An electromagnetic relay according to claim 1, wherein the electromagnet block has a pair of aligned iron cores connected by a yoke spanned across the lower ends of the iron cores.

6. An electromagnetic relay according to claim 2, wherein the electromagnet block has a pair of aligned iron cores connected by a yoke spanned across the lower ends of the iron cores.

* * * * *